US007571519B2

(12) United States Patent
Sierro

(10) Patent No.: US 7,571,519 B2
(45) Date of Patent: Aug. 11, 2009

(54) DEVICE FOR SETTING THE LENGTH OF A BRACELET, BRACELET PROVIDED WITH SUCH A DEVICE AND WATCH FITTED WITH SUCH A BRACELET

(75) Inventor: Alain André Sierro, Cornaux (CH)

(73) Assignee: Werthanor S.A., Le Locle (CH)

( * ) Notice: Subject to any disclaimer, the term of this patent is extended or adjusted under 35 U.S.C. 154(b) by 440 days.

(21) Appl. No.: 11/562,569

(22) Filed: Nov. 22, 2006

(65) Prior Publication Data

US 2007/0125123 A1 Jun. 7, 2007

(30) Foreign Application Priority Data

Nov. 23, 2005 (EP) ..... 05111135

(51) Int. Cl.
*A44B 21/00* (2006.01)
*A44B 11/00* (2006.01)

(52) U.S. Cl. ..... 24/71 J; 24/71 ST; 24/265 WS

(58) Field of Classification Search ..... None
See application file for complete search history.

(56) References Cited

U.S. PATENT DOCUMENTS

| | | | | |
|---|---|---|---|---|
| 1,863,917 | A * | 6/1932 | Bigney et al. | 24/71 J |
| 2,542,358 | A * | 2/1951 | Ritter | 24/71 R |
| 2,613,415 | A * | 10/1952 | Ritter | 24/71 J |
| 3,863,299 | A * | 2/1975 | Hocq | 24/71 J |
| 4,928,359 | A | 5/1990 | Gagnebin | |
| 5,689,859 | A | 11/1997 | Cuche | |
| 5,749,128 | A * | 5/1998 | Cuche | 24/71 J |
| 5,771,543 | A * | 6/1998 | Froidevaux et al. | 24/71 J |
| 5,927,577 | A * | 7/1999 | Braun | 224/176 |
| 6,308,382 | B1 * | 10/2001 | Takahashi et al. | 24/265 WS |
| 6,401,307 | B1 | 6/2002 | Wild | |

FOREIGN PATENT DOCUMENTS

| | | | |
|---|---|---|---|
| CH | 653 226 | A5 | 12/1985 |
| CH | 657 763 | A5 | 9/1986 |
| CH | 667 979 | A5 | 11/1988 |
| CH | 668 353 | A5 | 12/1988 |
| CH | 669 501 | A5 | 3/1989 |
| EP | 0 737 427 | A1 | 10/1996 |
| EP | 0 819 391 | A1 | 1/1998 |
| FR | 2.058.819 | | 5/1971 |

OTHER PUBLICATIONS

Search report issued in corresponding European Application No. EP 05 11 1135 completed Apr. 10, 2006.

* cited by examiner

*Primary Examiner*—Jack W. Lavinder
(74) *Attorney, Agent, or Firm*—Griffin & Szipl, P.C.

(57) ABSTRACT

The invention proposes a device for adjusting the length of a wristband or bracelet including a base plate and an adjusting link, the adjusting link being hinged on the base plate via at least one connecting rod which is hinged on the base plate via a main pin which is hinged on the adjusting link via a secondary pin, wherein the adjusting link is arranged so as to slide relative to the base plate, including a locking device allowing the adjusting link to catch on an anchoring element arranged on the base plate in at least two indexed longitudinal positions, respectively defining two lengths of the bracelet, characterized in that the anchoring element is arranged on the main pin.

The invention also proposes a bracelet fitted with this adjustment device and a watch fitted with such a bracelet.

15 Claims, 7 Drawing Sheets

DEVICE FOR SETTING THE LENGTH OF A BRACELET, BRACELET PROVIDED WITH SUCH A DEVICE AND WATCH FITTED WITH SUCH A BRACELET

This application claims priority from European Patent Application No. EP 05111135.9 filed 23 Nov. 2005, the entire disclosure of which is incorporated herein by reference.

FIELD OF THE INVENTION

The present invention concerns a device for quickly adjusting a bracelet or wristband to at least two lengths, particularly a bracelet fitted with a clasp with unfolding strips.

BACKGROUND OF THE INVENTION

Those skilled in the art of bracelet manufacture, particularly for wristwatches, know that the diameter of the human wrist varies as a function of the ambient temperature and the user's physical activity. During the hot season and/or during significant physical activity by the user, the diameter of the wrist increases whereas during the cold season and/or the absence of any physical activity, the diameter decreases. The need to be able to adjust the length of the bracelet to fit it to these differences in diameter can thus be understood, if one wishes to prevent, depending upon the circumstances, the bracelet being too loose around the wrist or gripping the wearer's wrist in an uncomfortable manner.

While leather straps with a tongue and buckle generally have enough holes to be fitted sufficiently finely around the wrist, bracelets with hinged links are adjusted in length by adding or removing a link from the chain of which they are formed. In addition to the fact that the fineness of the length adjustment is limited to the length of one link, this adjustment operation still has the drawback of requiring the intervention of a specialist.

Various systems have been proposed to date to try to overcome this problem. One can cite for example CH Patent No. 669 501 and FR Patent No. 2 058 819, which propose fine adjustment systems for a bracelet. However, these systems are all integrated in a clasp of the type with an unfolding buckle or strips and utilise complicated and thus expensive devices that are not easy to use.

In order to overcome these drawbacks, EP Patent No. 0737 427 proposed a link that could be adjusted in length independently of a clasp and could thus be placed anywhere in a bracelet with links. According to this Patent, the adjustable link includes a cap into which a base slides and a spring push-button mechanism to enable the link to extend to several different lengths. The push buttons each have one end which projects onto the lateral faces of the link and an opposite end provided with a notch cooperating with the teeth of two racks facing each other and provided in the cap. U.S. Pat. No. 5,749,128 also describes a similar type of system integrated in a clasp with unfolding strips.

Although this adjustable link and clasp allow satisfactory adjustment of the length of a bracelet in which they are integrated, the control push buttons are visible from the exterior and are detrimental to the general appearance of the bracelet in which they are integrated. Moreover, these adjustment mechanisms respectively include a large number of parts that makes them complex and expensive to implement.

EP Patent No. 819 391 further discloses a device for adjusting the length of a bracelet fitted with a clasp with unfolding strips wherein the length is adjusted by means of an adjusting link have two articulation pins respectively connected to the cap of the clasp and to an end link of the bracelet. The adjusting link can pivot in relation to the pin thereof connected to the cap of the clasp to allow the pin thereof connected to the end link to pass on either side of the pin connected to the cap to define two determined lengths. The end link connected to the adjusting link has a particular shape which, when the adjusting link is in the short length position, enables it to be locked onto the adjusting link in a resilient manner. According to this device, the distance between the two articulation pins of the adjusting link determines the gap between the short length and the long length, this gap being equal to twice said distance. The choice of this length-adjusting gap is thus limited in practice by construction restrictions of the adjusting link that cannot be less than 5 mm. Moreover, this device has the drawback of only providing a choice of two determined lengths.

CH Patent No. 667 979 discloses and shows a clasp with unfolding strips wherein the adjusting link is hinged on the cap of the clasp via a connecting rod whose secondary articulation pin is slidably mounted on the adjusting link. However, the locking device disclosed in this Patent includes a relatively complex and cumbersome pusher mechanism, which is detrimental to the aesthetic appearance of the bracelet.

It is thus a main object of the present invention to overcome the drawbacks of the aforementioned prior art by furnishing a device for adjusting the length of a bracelet that allows a choice as to the spacing of the bracelet length adjustment which is independent of the distance between the articulation pins of the adjusting link on the base plate. This adjustment device must also be compact to be able to be easily integrated in a bracelet link or in a clasp with unfolding strips.

It is also an object of the present invention to furnish a device for adjusting the length of a bracelet that can be used simply by the user without using any tools.

It is also an object of the present invention to furnish a device for adjusting the length of a bracelet that is of simple, reliable and inexpensive construction.

SUMMARY OF THE INVENTION

The invention therefore proposes a device for adjusting the length of a bracelet, particularly fitted with a clasp with unfolding strips, to be inserted generally longitudinally between two end strands of the bracelet, the adjustment device including a base plate at a first longitudinal end and an adjusting link at a second longitudinal end, the adjusting link being hinged on the base plate via at least one connecting rod which is hinged, by a first end, on the base plate via a first transverse articulation pin called the main pin and which is hinged, by a second end, on the adjusting link via a second transverse articulation pin, called the secondary pin, wherein the adjusting link is arranged so as to slide relative to the base plate along the longitudinal direction of the bracelet, including a locking device for catching the adjusting link on an anchoring element arranged on the base plate in at least two indexed longitudinal positions, respectively defining two lengths of the bracelet, characterized in that the anchoring element is arranged on the main pin.

Owing to these features, the person wearing the bracelet can easily pass, without any skill or particular tool, from a first bracelet length to at least a second bracelet length. The gap between the different lengths is of the order of several millimetres and thus compensates precisely for variations in the periphery of the wrist caused particularly by the ambient heat and thus to improving the wearing comfort of the bracelet in all circumstances.

In a preferred embodiment, the adjusting link is hinged on the base plate by two connecting rods which are arranged on either side of its transverse ends, which facilitates the provision of compact and rigid adjustment device, in particular in torsion.

In an advantageous embodiment the anchoring element can be made of the median section of a main pin which is secured to the base plate and which forms the main pin, each connecting rod being hinged on a transverse end section of the main pin. The same element is thus used as a hinge for the connecting rods and for locking the adjusting link. Moreover, the base plate can include several pairs of opposite housings which are distributed in several longitudinal positions and which are provided for receiving the two ends of the main pin so as to allow an additional adjustment of the length of the bracelet by altering the longitudinal position of the main pin on the base plate.

In a preferred embodiment, the locking device includes at least two notches arranged in the adjusting link for cooperating by snap fit with the anchoring element. These notches are integral with the adjusting link, which allows the locking device to be made with the minimum number of parts and best compactness.

In a preferred embodiment, the adjusting link includes a longitudinal oblong hole, and the secondary pin is formed by a secondary pin which is secured to the connecting rods and which is received by sliding into the oblong hole. Thus, the sliding is achieved without the addition of any extra parts.

Advantageously, the adjustment device can include at least one locking element which restricts the pivoting of the connecting rods around the main pin in a determined angular section, preferably less than or equal to eighty-six degrees, which prevents the connecting rods turning over, when moving the adjusting link away from the main pin.

Preferably, in at least one of the indexed longitudinal positions of the adjusting link, one longitudinal end of the adjusting link is substantially aligned with the longitudinal end of a connecting rod, to improve the compactness of the locking device.

According to an advantageous embodiment, the adjusting link is hinged on the inner face of the base plate, on the side of the wrist wearing the bracelet, which conceals the locking device on the inner side of the bracelet.

Preferably, the base plate is formed by the cap of a clasp with unfolding strips.

The present invention also proposes a bracelet, particularly for a watch worn on the wrist, characterized in that it includes a device for adjusting its length in accordance with one of the preceding features.

The present invention further proposes a watch characterized in that it includes a bracelet including a device for adjusting its length in accordance with one of the preceding features.

BRIEF DESCRIPTION OF THE DRAWINGS

Other features and advantages of the present invention will appear in the following description of a preferred embodiment of an adjustment device according to the invention, given by way of non-limiting example with reference to the annexed drawings, in which.

DETAILED DESCRIPTION OF THE ILLUSTRATIVE EMBODIMENTS

Figure 1:
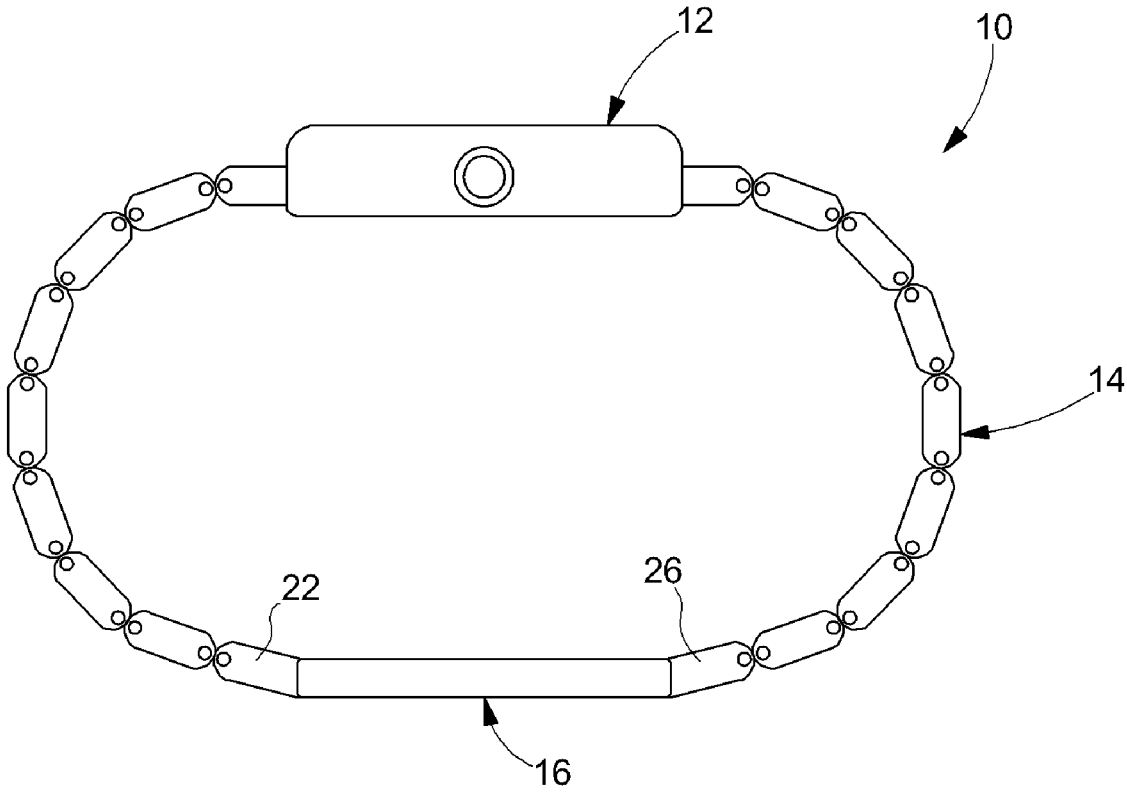
FIG. 1 is a perspective view which shows schematically a wristwatch fitted with a bracelet length adjustment device made in accordance with the teaching of the invention.

FIG. 1 shows a wristwatch 10 which is made in accordance with the teaching of the invention.

Wristwatch 10 includes a case 12 containing a movement and a display system, and a wristband or bracelet 14 which is secured to either side of case 12.

Bracelet 14 is of the type here with hinged links and it is fitted with a clasp 16 with unfolding strips. As this type of clasp 16 is well known to those skilled in the art, it will not be described in detail.

Figure 2:
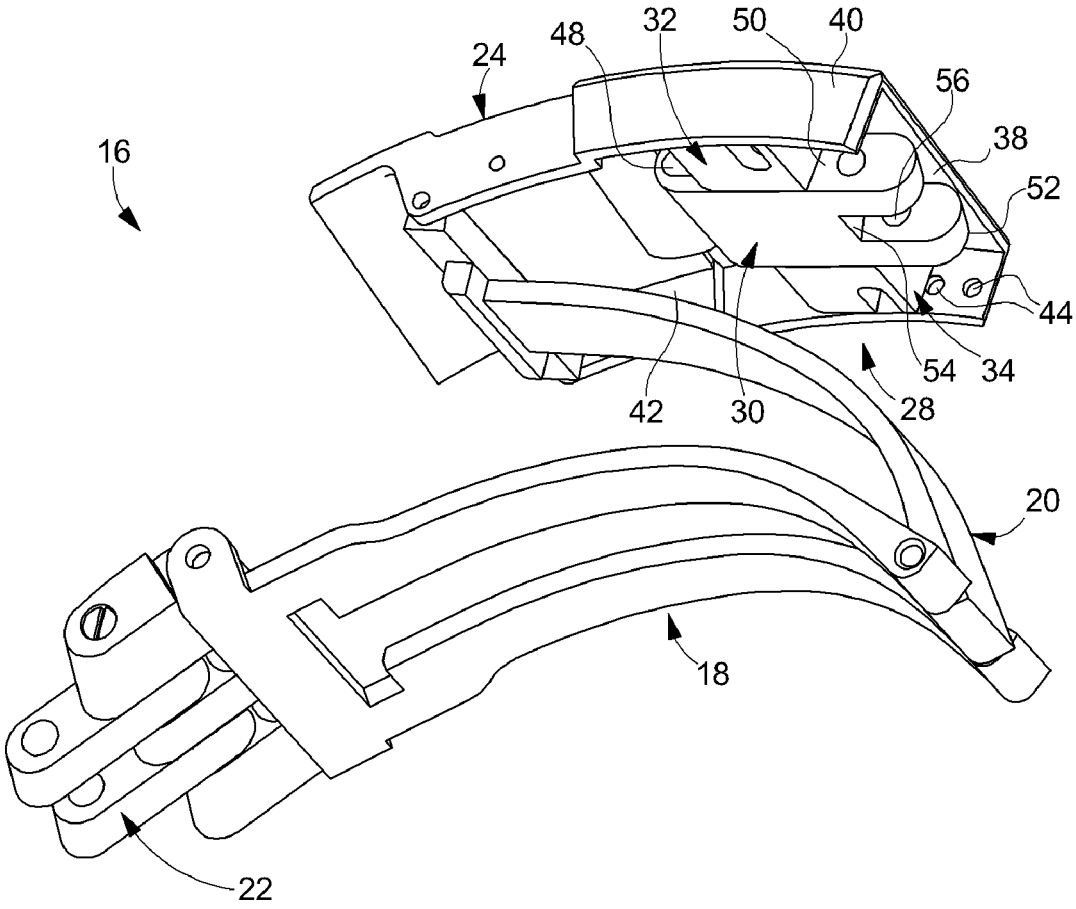
FIG. 2 is a perspective view which shows schematically the clasp with unfolding strips of the bracelet of FIG. 1 in the open position when the adjustment device is occupying its short position corresponding to a first bracelet length.

According to the diagram of FIG. 2, clasp 16 includes two superposable strips 18, 20 which are hinged in relation to each other at one of their ends, the other end being hinged respectively on a first end link 22 of bracelet 14 and on a base plate called a cover 24 connected to a second end link 26 of bracelet 14.

A device 28 for adjusting the length of bracelet 14 is inserted generally longitudinally between two end strands of bracelet 14 formed here by a strip 20 and by the second end link 26, cap 24 belonging to adjustment device 28.

In the following description, an overall longitudinal orientation will be used in a non-limiting manner, corresponding to the general direction of bracelet 14 in the direction of its length and a transverse orientation that is overall orthogonal to the longitudinal direction. The words "inner" and "outer" will also be used in a non-limiting manner to qualify elements depending upon whether they are located on the side of the wrist wearing bracelet 14 or on the side opposite said wrist.

In addition to cover 24, adjustment device 28 includes an adjusting link 30 which is hinged on the second end link 26. The adjusting link 30 is hinged on cover 24 via two connecting rods 32, 34 which are arranged in parallel on either side of its transverse ends. Each connecting rod 32, 34 is hinged, by a first longitudinal end, on cover 24 via a first transverse articulation pin called the main pin A1, and by a second longitudinal end, to the adjusting link via a second transverse articulation pin called the secondary pin A2.

Of course, according to an alternative embodiment (not shown) of the invention, the adjusting link 30 could be hinged on cover 24 via a single connecting rod.

Advantageously, main pin A1 is formed by a main pin 36 which extends from the side of the inner face 38 of cover 24, between two longitudinal wings 40, 42 integral with cover 24. For this purpose, cover 24 includes a pair of housings 44 arranged in the wings opposite each other for receiving the ends of main pin 36. Preferably, cover 24 includes several pairs of housing 44 shifted longitudinal in relation to each other, so as to allow an additional adjustment of the length of bracelet 14 by altering the longitudinal position of main pin 36.

Adjustment link 30 is arranged so as to slide relative to cover 24 along an overall longitudinal direction. According to the embodiment shown here, adjusting link 30 has the overall shape of a longitudinal plate of oblong profile. In the thickness thereof, adjusting link 30 includes an oblong longitudinal hole 46 for a secondary pin 48 to slide into, said pin being fixed to connecting rods 32, 34 and forming secondary articulation pin A2. Oblong hole 46 is a through hole and it opens into the two transverse end faces 50, 52 of adjusting link 30.

Oblong hole 46 extends into a first longitudinal end portion of adjusting link 30. In a second longitudinal end portion, adjusting link 30 includes a mounting notch 54 and a housing 56 for fixing it and its hinge onto the second end link 26 of bracelet 14.

According to variants (not shown) of the invention, oblong hole 46 can be made in connecting rods 32, 34 either so that secondary pin A2 is secured to adjusting link 30 and slides in relation to connecting rods 32, 34, or so that secondary pin A2 is stationary in relation to connecting rods 32, 34 and to adjusting link 30 and so that main pin A1 is received in oblong hole 46 to enable connecting rods 32, 34 to slide in relation to main pin A1.

Adjusting device 28 also includes a locking device 58 which allows adjusting link 30 to hook onto an anchoring element 60 arranged on cover 24 in at least two indexed longitudinal positions, called the long position Pl and short position Pc, respectively defining two lengths of bracelet 14.

In accordance with the teaching of the invention, anchoring element 60 is arranged on the main articulation pin A1. More specifically, a fixed cylindrical section which extends between the two connecting rods 32, 34 and which is coaxial to main pin A1 forms anchoring element 60. Advantageously, this cylindrical section is formed by the median section of main pin 36, thus main pin 36 is used both as a hinge for the pivoting of connecting rods 32, 34 and as anchoring element 60 for the locking device 58.

A first notch 62, corresponding to the long position Pl, and a second notch 64, corresponding to the short position Pc, are arranged in an intermediate portion of adjusting link 30, between the first and second longitudinal end portions, to allow adjusting link 30 to catch on anchoring element 60. These notches 62, 64 are formed by two transverse grooves, which are arranged in a longitudinal face of adjusting link 30 and which open into the transverse end faces 50, 52 of adjusting link 30. Notches 62, 64 can thus be made integrally with adjusting link 30.

According to a preferred embodiment, the width of each notch 62, 64, in a longitudinal direction, is substantially equal to the external diameter of anchoring element 60 so as to hold anchoring element 60 longitudinally on adjusting link 30. Each notch 62, 64 includes at least one raised portion 66 causing a localised restriction in width which allows adjusting link 30 to fit resiliently onto anchoring element 60. This fit is obtained by a resilient deformation of main pin 36 when passing over raised portion 66, the latter holding main pin 36 in the bottom of the corresponding notch 62, 64.

According to a variation (not shown) of the invention, adjusting link 30 can includes more than two notches 62, 64.

A variant (not shown) of locking device 58 according to the invention can be obtained by mechanical reversal, by making anchoring element 60 in the form of a notch or a hook, and by replacing notches 62, 64 of adjusting link 30 with complementary pins of anchoring element 60.

It should be noted that the thickness of adjusting link 30 and of connecting rods 32, 34 is substantially the same here, such that, in the locked position, their outer faces are contained overall in the same longitudinal plane. Thus, owing to the surface continuity between adjusting link 30 and connecting rods 32, 34, a particularly compact adjustment device 28 is obtained wherein locking device 58 is practically invisible in the locked position.

The operation of adjustment device 28 according to the invention will now be described, with particular reference to FIGS. 2 to 10, which shows adjustment device 28 in several intermediate positions and in its indexed positions Pc, Pl.

Figure 3:
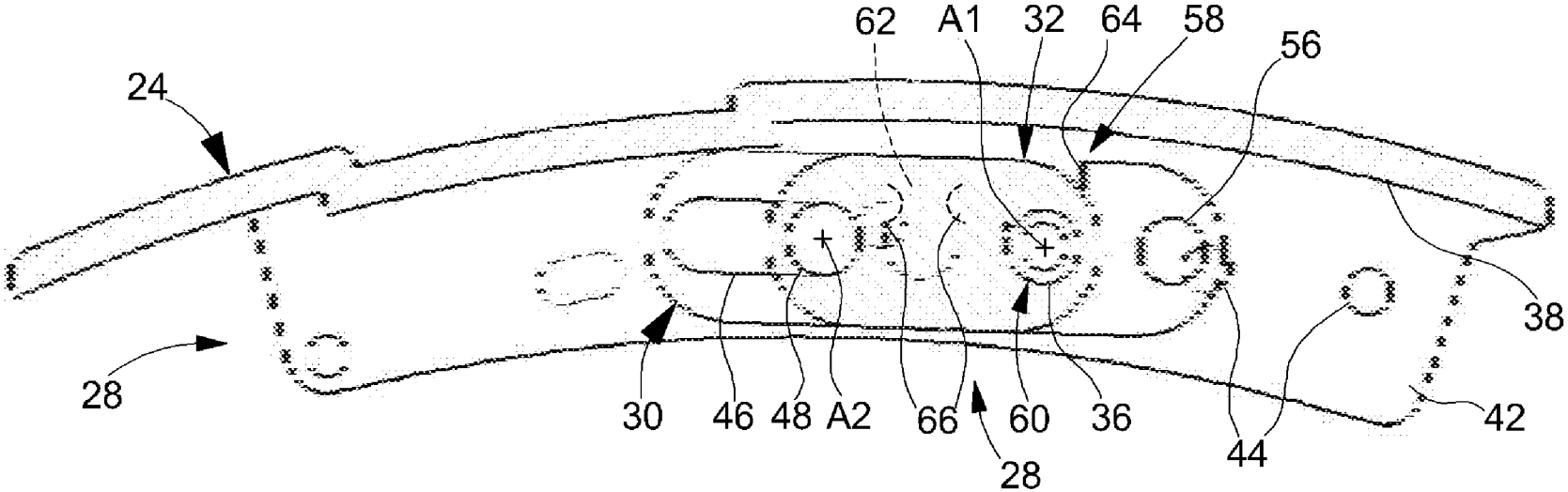
FIG. 3 is a longitudinal cross-section which shows the adjustment device in the short position.

FIGS. 2 and 3 show adjustment device 28 locked in the short position Pc. Connecting rods 32, 34 and adjusting link 30 then extend longitudinally in a substantially parallel plane to the inner face 38 of cover 24, and adjusting link 30 is caught on anchoring element 60 via the second notch 64. It should be noted that, in this configuration, secondary pin 48 is substantially adjacent to the end of oblong hole 46 located on the side of notches 62, 64. The elements used for adjusting the length of bracelet 14 are then concealed under cover 24.

The passing from short position Pc to long position Pl will now be described, with the length of bracelet 14 being adjusted when clasp 16 is open.

The user pulls manually the end of adjusting link 30 where the second end link 26 of bracelet 14 is hinged, so as to release adjusting link 30 from anchoring element 60. After passing the hard point due to the passage of locking raised portion 66, adjusting link 30 pivots inward about secondary pin A2, in the clockwise direction looking at FIG. 4, and connecting rods 32, 34 pivot inwards about main pin A1, in the anti-clockwise direction looking at FIG. 4, in order to allow adjusting link 30 to move away from the inner face 38 of cover 24. Adjusting link 30 and connecting rods 32, 34 are then in the first intermediate configuration which is shown in FIGS. 4 and 5.

Figure 4:
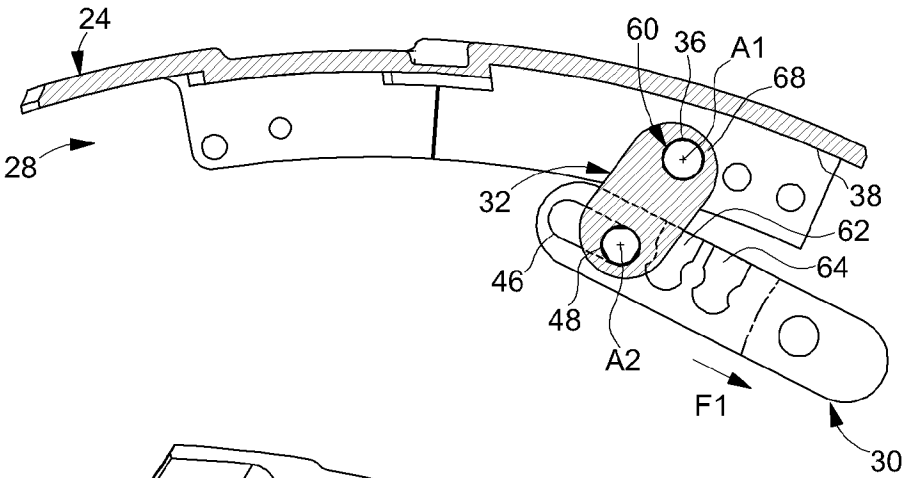
FIG. 4 is a similar view to that of FIG. 3 which shows the adjustment device in a first intermediate position towards the long position.
Figure 5:
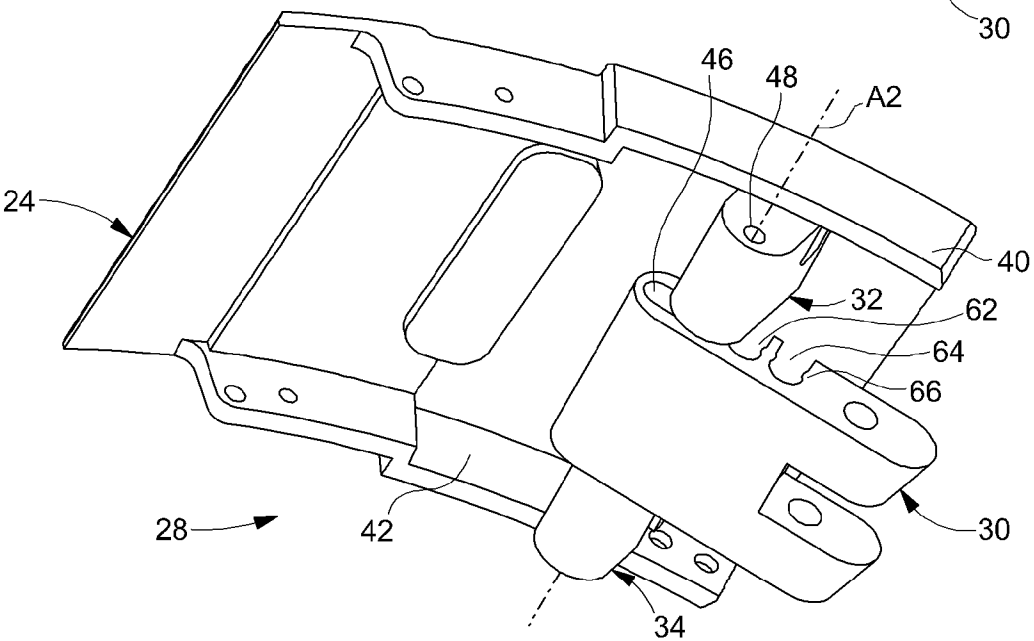
FIG. 5 is a similar view to that of FIG. 2 which shows the adjustment device in the first intermediate position.
Figure 6:
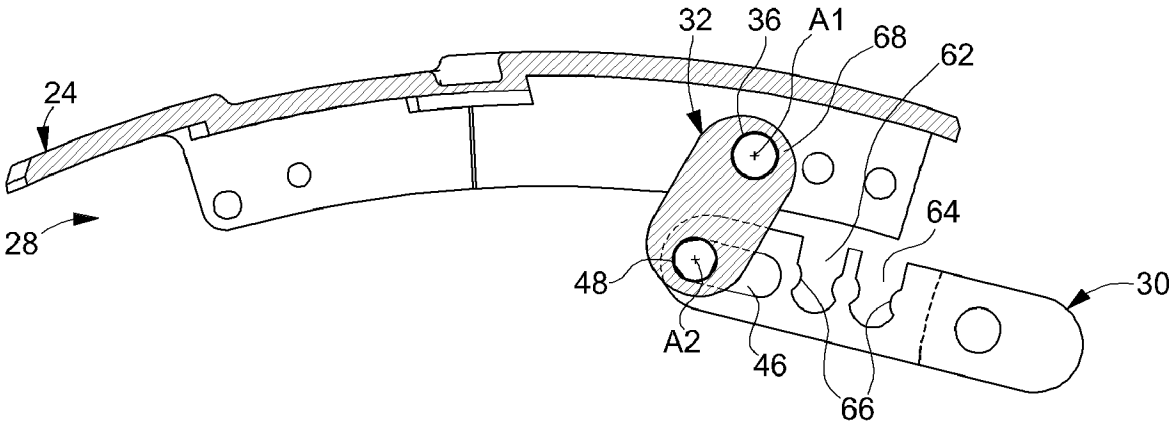
FIGS. 6 and 7 are similar views respectively to those of FIGS. 4 and 5 which show the adjustment device in a second intermediate position towards the short position.
Figure 7:
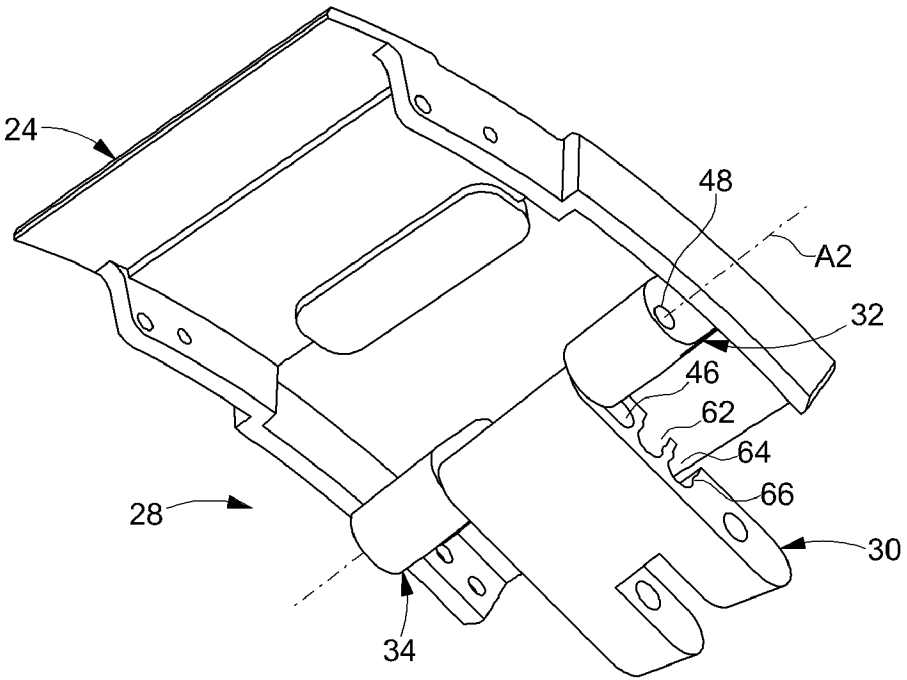

In order to lengthen bracelet 14, the user slides adjusting link 30 manually in relation to secondary pin A2, towards the right in the overall direction of arrow F1 looking at FIG. 4, until secondary pin 48 is substantially adjacent to the end of oblong hole 46 on the side opposite notches 62, 64. This second intermediate configuration is shown in FIGS. 6 and 7.

From this second intermediate configuration, the user pushes adjusting link 30 towards cover 24, pivoting adjusting link 30 and connecting rods 32, 34 in the opposite direction to that indicated with reference to FIGS. 3 and 4, so as to fit adjusting link 30 onto anchoring element 60 with first notch 62, which corresponds to the long position Pl. Adjusting link 30 the occupies its long position Pl in which, as for short position Pc, adjusting link 30 and connecting rods 32, 34 extend parallel to each other in a longitudinal plane.

Figure 8:
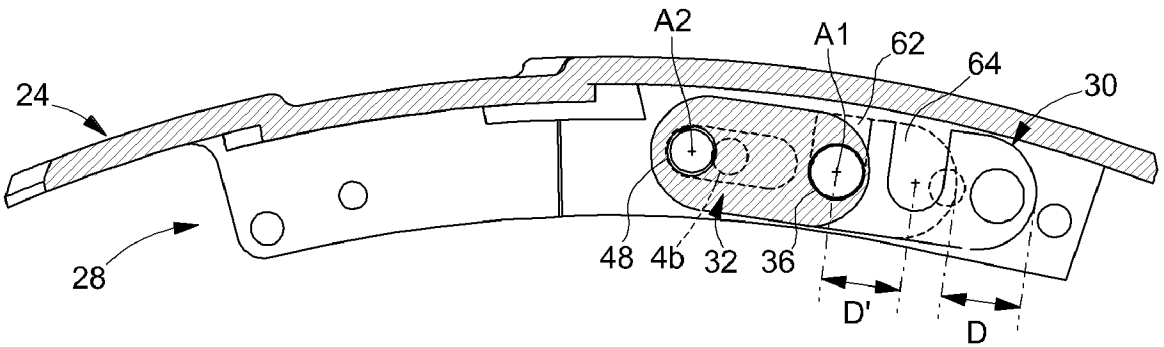
FIGS. 8 and 9 are similar views respectively to those of FIGS. 4 and 5 which show the adjustment device in the long position.
Figure 9:
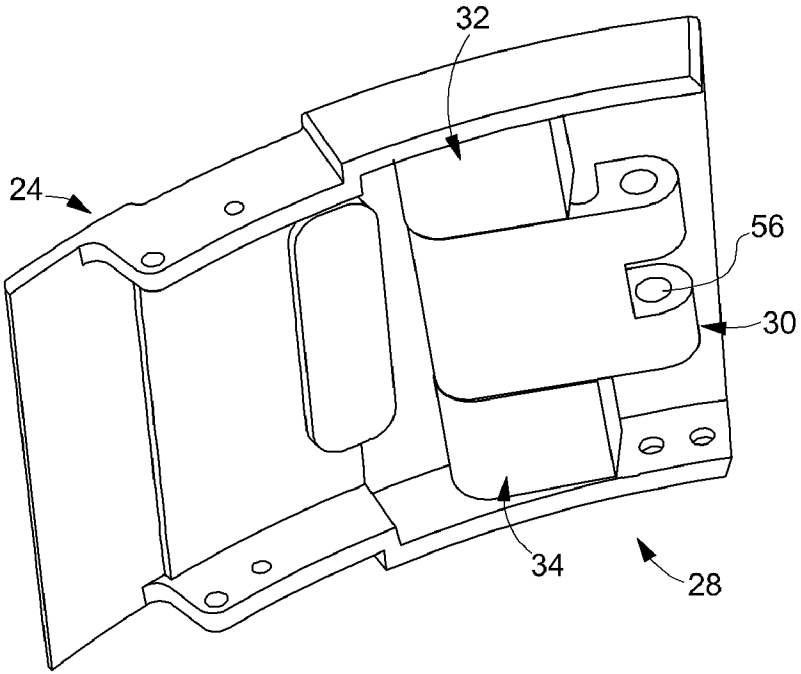
Figure 10:
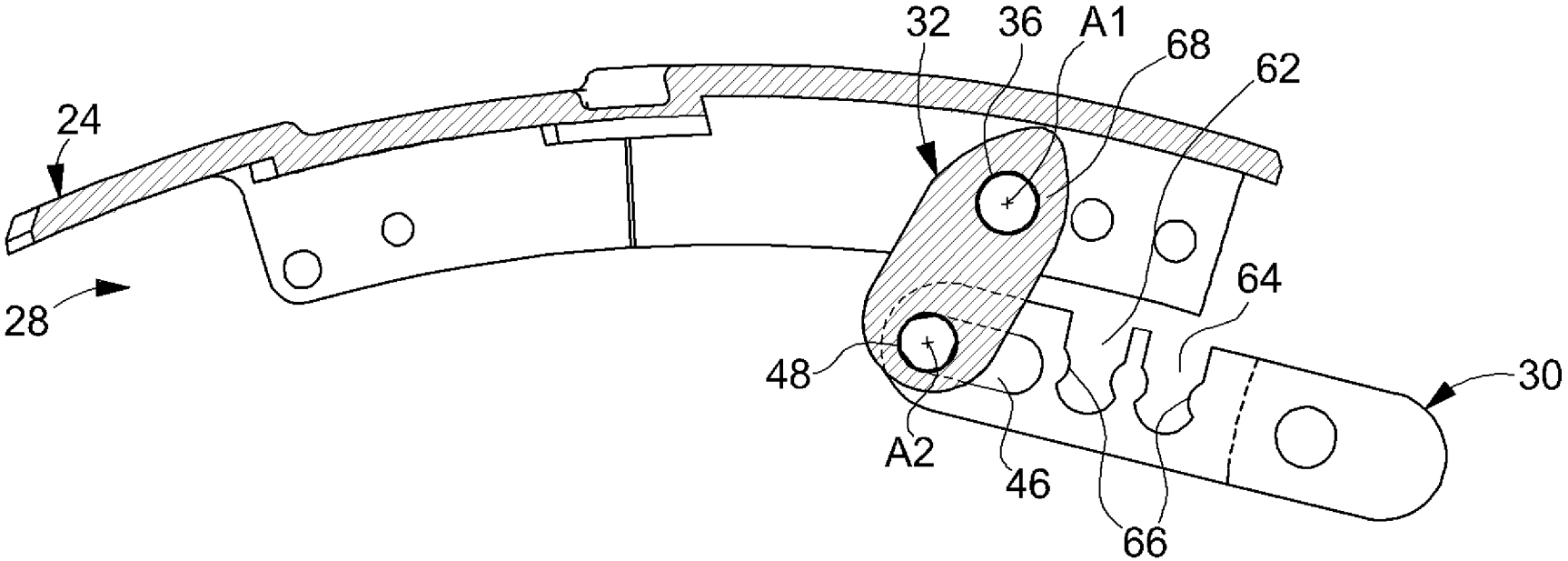
FIG. 10 is a similar view to FIG. 6 of an alternative embodiment of the adjustment device of the invention.

FIGS. 8 and 9 illustrate the long position Pl. In these Figures, it will be noted that adjusting link 30 is shifted towards the right longitudinally, in relation to the short position Pc, by an adjusting distance D equal to the distance D' between the centre of the two notches 62, 64. Typically, the adjusting distance D can be of the order of two millimetres, which allows fine adjustment of the length of bracelet 14 and ensures maximum comfort for the user.

It should be noted that, in the two indexed positions Pc, Pl, the secondary pin A2 is positioned on the same side of primary pin A1, on the opposite side to second end link 26.

According to a preferred embodiment, in the long position Pl, the longitudinal end of adjusting link 30 located on the side of oblong hole 46 is substantially aligned transversely with the longitudinal end of connecting rods 32, 34, located on the side of secondary pin A2 and, in the short position Pc, adjusting link 30 extends longitudinally and symmetrically on either side of connecting rods 32, 34. This arrangement provides a particularly compact adjustment device 28 and allows locking device 58 to be concealed.

The passing from the long position Pl to the short position Pc is carried out in a similar way to the passing from the short position Pc to the long position Pl, by sliding adjusting link 30 in relation to secondary pin A2 in the opposite direction to arrow F1 of FIG. 4.

It should be noted that, the unlocked position of adjusting link 30 could constitute an additional adjusting position in which the length of bracelet 14 is larger than when adjusting link 30 occupies its long position Pl. Indeed, in the unlocked position, secondary pin A2 can pass from the other side of main pin A1, from the side of second end link 26, which lengthens bracelet 14.

When this additional adjustment position is not required, a locking element 68 is provided (FIG. 10), which restricts the pivoting of connecting rods 32, 34 about main pin A1 in a determined angular sector, preferably less than or equal to ninety degrees. According to the embodiment shown in the Figures, locking element 68 is formed by an end portion of each connecting rod 32, 34 which is stopped against the inner face 38 of cover 24 when the associated connecting rod 32, 34 comes close to a perpendicular position to cover 24.

Although the invention has been described in relation to a bracelet including a clasp with unfolding strips, it can apply to other types of bracelet. The invention is particularly suited to bracelets with hinged links.

What is claimed is:

1. A device for adjusting the length of a wristband or bracelet, particularly fitted with a clasp with unfolding strips, to be inserted generally longitudinally between two end strands of the bracelet, the adjustment device including a base plate at a first longitudinal end and an adjusting link at a second longitudinal end, the adjusting link being hinged on the base plate via at least one connecting rod, which is hinged, by a first end, on the base plate via a first transverse articulation pin called the main pin and which is hinged, by a second end, on the adjusting link via a second transverse articulation pin called the secondary pin, wherein the adjusting link is arranged so as to slide relative to the base plate along the longitudinal direction of the bracelet, including a locking device enabling the adjusting link to catch on an anchoring element arranged on the base plate in at least two indexed longitudinal positions respectively defining two bracelet lengths, wherein the anchoring element is arranged on the main pin.

2. The device according to claim 1, wherein the adjusting link is hinged on the base plate via two connecting rods which are arranged on either side of the transverse ends of the adjusting link.

3. The device according to claim 2, wherein the anchoring element is formed by the median section of a main pin which is secured to the base plate and which forms the main pin, each connecting rod being hinged on one transverse end section of the main pin.

4. The device according to claim 3, wherein the base plate includes several pairs of opposite housings that are distributed in several longitudinal positions and which are for receiving both ends of the main pin so as to allow an additional adjustment of the length of the bracelet by altering the longitudinal position of the main pin on the base plate.

5. The device according to claim 2, wherein the adjusting link includes an oblong longitudinal hole, and wherein the secondary pin is formed by a secondary pin which is secured to the connecting rods and which slides into the oblong hole.

6. The device according to claim 1, wherein the locking device includes at least two notches arranged in the adjusting link for cooperating by a snap fit with the anchoring element.

7. The device according to claim 6, wherein each notch includes in the inner wall thereof at least one raised portion for holding the adjusting link on the anchoring element by a resilient snap fit.

8. The device according to claim 7, wherein the notches are integral with the adjusting link.

9. The device according to claim 6, wherein the notches are integral with the adjusting link.

10. The device according to claim 1, wherein, in at least one of the indexed longitudinal positions of the adjusting link, one longitudinal end of the adjusting link is substantially aligned with the longitudinal end of a connecting rod.

11. The device according to claim 1, including at least one locking element that restricts the pivoting of the connecting rods about the main pin in a determined angular sector.

12. The device according to claim 1, wherein the adjusting link is hinged on the inner face of the base plate, on the side of the wrist that is wearing the bracelet.

13. The device according to claim 12, wherein the base plate is formed by the cover of a clasp with unfolding strips.

14. A wristband or bracelet, particularly for a watch worn on the wrist, including a device for adjusting the length of a wristband or bracelet, particularly fitted with a clasp with unfolding strips, to be inserted generally longitudinally between two end strands of the bracelet, the adjustment device including a base plate at a first longitudinal end and an adjusting link at a second longitudinal end, the adjusting link being hinged on the base plate via at least one connecting rod, which is hinged, by a first end, on the base plate via a first transverse articulation pin called the main pin and which is hinged, by a second end, on the adjusting link via a second transverse articulation pin called the secondary pin, wherein the adjusting link is arranged so as to slide relative to the base plate along the longitudinal direction of the bracelet, including a locking device enabling the adjusting link to catch on an anchoring element arranged on the base plate in at least two indexed longitudinal positions respectively defining two bracelet lengths, wherein the anchoring element is arranged on the main pin.

15. A watch including a wristband or bracelet fitted with a device for adjusting the length of a wristband or bracelet, particularly fitted with a clasp with unfolding strips, to be inserted generally longitudinally between two end strands of the bracelet, the adjustment device including a base plate at a first longitudinal end and an adjusting link at a second longitudinal end, the adjusting link being hinged on the base plate via at least one connecting rod, which is hinged, by a first end, on the base plate via a first transverse articulation pin called the main pin and which is hinged, by a second end, on the adjusting link via a second transverse articulation pin called the secondary pin, wherein the adjusting link is arranged so as to slide relative to the base plate along the longitudinal direction of the bracelet, including a locking device enabling the adjusting link to catch on an anchoring element arranged on the base plate in at least two indexed longitudinal positions respectively defining two bracelet lengths, wherein the anchoring element is arranged on the main pin.

* * * * *